US005513938A

United States Patent [19]

Chambers

[11] Patent Number: 5,513,938

[45] Date of Patent: May 7, 1996

[54] WHEEL LIFT ROTATOR

[75] Inventor: Robert P. Chambers, Fayetteville, Pa.

[73] Assignee: International Marketing, Inc., Chambersburg, Pa.

[21] Appl. No.: 415,187

[22] Filed: Apr. 3, 1995

[51] Int. Cl.[6] ..... B05C 13/02

[52] U.S. Cl. ..... 414/427; 414/433; 414/590; 414/757; 414/786; 118/320

[58] Field of Search ..... 414/426, 427, 414/433, 589, 590, 746.3, 757, 786; 118/232, 320; 29/402.18

[56] References Cited

U.S. PATENT DOCUMENTS

| | | | |
|---|---|---|---|
| 1,700,697 | 1/1929 | Draper | 414/433 X |
| 1,924,005 | 8/1933 | Stevens | 414/433 X |
| 3,159,126 | 12/1964 | Beecher | 414/433 |
| 3,805,983 | 4/1974 | Gallo | 414/427 |
| 3,952,892 | 4/1976 | Robinson et al. | 414/433 |
| 4,091,597 | 5/1978 | Sanderson et al. | 414/433 X |
| 4,288,193 | 9/1981 | Klausbruckner et al. | 414/589 X |
| 4,739,724 | 4/1988 | Giordano | 118/320 X |
| 4,763,392 | 8/1988 | Fogal et al. | 29/159.1 |
| 4,950,505 | 8/1990 | Fogal | 427/327 |
| 5,098,744 | 3/1992 | Enegren | 427/327 |
| 5,226,971 | 7/1993 | Fogal et al. | 134/17 |
| 5,244,506 | 9/1993 | Enegren | 118/35 |
| 5,291,696 | 3/1994 | Enegren | 51/420 |
| 5,297,915 | 3/1994 | Bach | 414/590 |

*Primary Examiner*—James W. Keenan
*Attorney, Agent, or Firm*—Oldham & Oldham Co.

[57] ABSTRACT

The present invention is directed to an apparatus for use in a paint booth to facilitate the coating of an object such as a wheel or rim with a liquid, powder, or other coating. The apparatus is designed to rotate a wheel about both its horizontal and vertical axes. In this manner, the wheel may be more easily and uniformly coated with a minimum of effort by a paint booth operator. After the wheel is coated, the apparatus is designed to lift the object above the work surface so that it can be connected to an overhead conveyor system that may be provided to remove the wheel from the paint booth.

17 Claims, 3 Drawing Sheets

WHEEL LIFT ROTATOR

FIELD OF INVENTION

The present invention relates to wheel refinishing, and more particularly to an apparatus designed to facilitate the application of a coating to a wheel or rim.

BACKGROUND OF THE INVENTION

It has been found desirable to periodically remove the wheels from over-the-road trucks and other vehicles so that the wheels may be cleaned, stripped of old paint and rust, and recoated with a paint, powder, or other similar coating. In addition to increasing the life of the wheel by slowing the corrosion process, wheel refinishing results in a wheel that is better able to form a seal with the bead region of a mounted tire to provide a wheel/tire assembly that is less likely to lose air pressure.

For safety, environmental, and manufacturing considerations, the coating of a cleaned wheel is typically performed within a paint booth designed to prevent or inhibit fumes and other contaminants from entering the atmosphere. In present systems, once a wheel is located in the paint booth, the operator uses a hand-held spray gun apparatus to direct paint onto the various portions of the wheel as desired. Although existing systems may include one or more rolling or rotating elements for spinning or rotating a wheel while it is being painted, these prior systems are capable of rotating a wheel only about a single axis. These systems increase the necessary amount of time consuming labor by requiring the paint booth operator to reach into the paint booth with the spray gun, along the sides and behind the wheel being painted to adequately coat the wheel. One prior system requires the operator to transfer the wheel from a first rolling apparatus that rotates a standing wheel in the vertical plane to a second apparatus designed to rotate a wheel laying on its side in the horizontal plane. Also, these prior systems require the paint booth operator to manually move a coated wheel from the paint booth to a drying rack or other storage location. Therefore, these prior systems require a large amount of manual labor on the part of the paint booth operator. Given the weight of these wheels, especially those for use on over-the-road trucks, this manual labor is time consuming and generally slows down the rate at which wheels may be refinished. Also, it has been found that the repetitive motions required of the paint booth operator are very tiring.

The configuration of these prior paint booth systems requires the paint spray gun apparatus to be directed at the wheel from a variety of different angles. This nonuniformity of the spray painting angle, in conjunction with the substantially constant direction of the exhaust flow within the paint booth, makes it difficult to apply an even coat of paint to all wheel surfaces as is required. For example, while painting one portion of a wheel, the operator may be applying paint at an angle crossing the exhaust flow, and while painting a different portion of a wheel, the operator may be applying paint generally in the same direction as the exhaust flow. These different paint application angles result in a nonuniform paint coating being applied to the wheel.

SUMMARY OF THE INVENTION

The present invention is therefore directed to an apparatus for use in a paint booth to facilitate the coating of a wheel, said apparatus comprising a base, and a wheel support frame having upper and lower regions wherein said wheel support frame is supported on said base for rotation about a vertical axis relative to said base, said upper region of said wheel support frame having at least one roller connected thereto wherein said at least one roller has a longitudinal axis and wherein said at least one roller is supported for rotation about said longitudinal axis.

The invention may further comprise a motor drivingly connected to said at least one roller to transmit torque or rotation thereto.

The invention may further comprise means for elevating the wheel being coated to a wheel hook provided as part of an overhead conveyor system to facilitate removal of the painted wheel from the paint booth.

The present invention provides the advantage of allowing a paint booth operator to coat substantially all portions of a wheel without requiring difficult and time consuming painting operations, without requiring the operator to manually lift and move the wheel, and without requiring the operator to apply the coating at substantially different angles relative to the exhaust flow of the paint booth. Also, the present invention provides a simple and easy means for elevating a wheel allowing it to be easily attached to an overhead conveyor system designed to facilitate the removal of the wheel from the paint booth.

DETAILED DESCRIPTION OF THE PREFERRED EMBODIMENT

Wheel refinishing systems are generally known and commercially available. For example, prior wheel refinishing systems are sold by International Marketing Incorporated (IMI), Chambersburg, Penna. 17201 and various methods for the use of such wheel refinishing systems are described and claimed in U.S. Pat. Nos. 4,763,392, 4,950,505 and 5,226,971 all of which patents are incorporated by reference herein. It should be noted that, as used herein, the term "wheel" is meant to designate at least either a complete wheel, or merely the rim component thereof.

Figure 1:
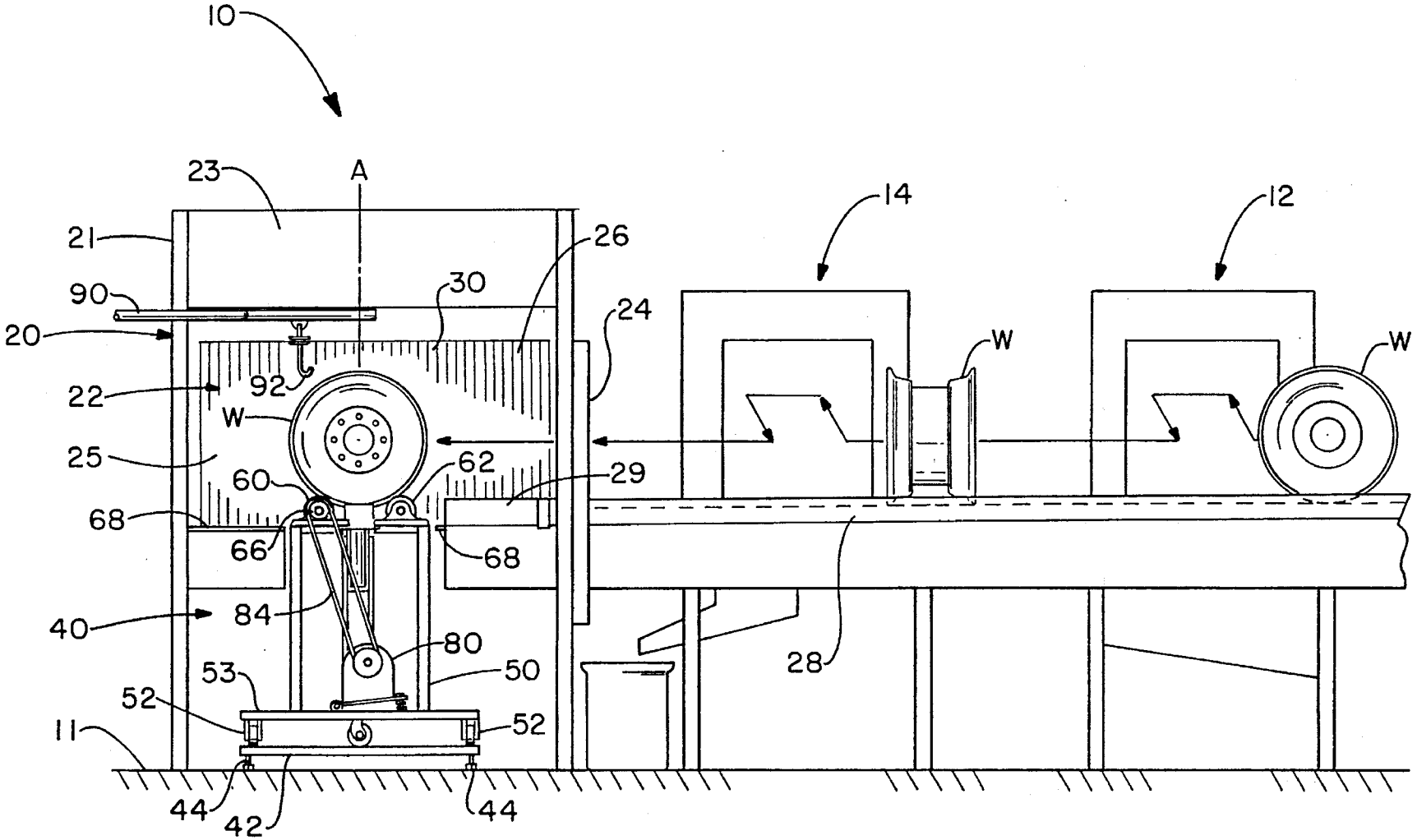
FIG. 1 is a front schematic view showing a three station wheel refinishing system including a paint booth utilizing the present invention.

A three part wheel refinishing system is shown generally at 10 in FIG. 1 and comprises a wheel washing/degreasing chamber 12 for cleaning dirt and grease from a wheel W, a shot blast chamber 14 for impinging substantially all surfaces of a wheel W with a particulate substance such as metallic shot pieces to remove paint and rust from wheel W, and a paint booth 20 for coating all surfaces of a cleaned wheel W with a coating such as a paint or another suitable coating. The wheel lift rotator of the present invention is shown generally at 40 as it may be used in conjunction with paint booth 20 to facilitate the painting of a wheel W.

Paint booth 20 comprises a housing 21 defining a substantially hollow painting chamber 22 having a hood 23, a side wheel entrance opening 24, front access opening 25, and rear opening 26. An exhaust system (not shown) is connected to paint booth 20 to draw air and air-borne particles from within painting chamber 22 through a filter 30 spanning at least a substantial portion of rear opening 26 of paint booth 20 to filter paint and other contaminants from the air contained within chamber 22 before the air is allowed to escape into the surrounding atmosphere.

A conveyor tray 28 is provided at the front of chambers 12, 14 of the wheel refinishing system 10 to facilitate movement of a wheel W between chambers 12, 14, 20. Tray 28 may be one-piece or may be provided in sections to be bolted or otherwise joined to each other and to the chambers 12, 14, 20 that may be provided as a part of the wheel refinishing system 10. Conveyor tray 28 abuts paint booth 20 adjacent to side wheel entrance opening 24 and may be joined by bolts or otherwise to tray member 29 which is preferably provided as a part of wheel lift rotator 40. In this manner, a wheel W may be rolled along tray 28 and tray member 29 into paint booth 20 and onto the wheel lift rotator 40 as is described in greater detail below. Conveyor tray 28 may be a mechanized apparatus, but is preferably an angled tray member allowing the wheel to be rolled thereon.

Figure 2:
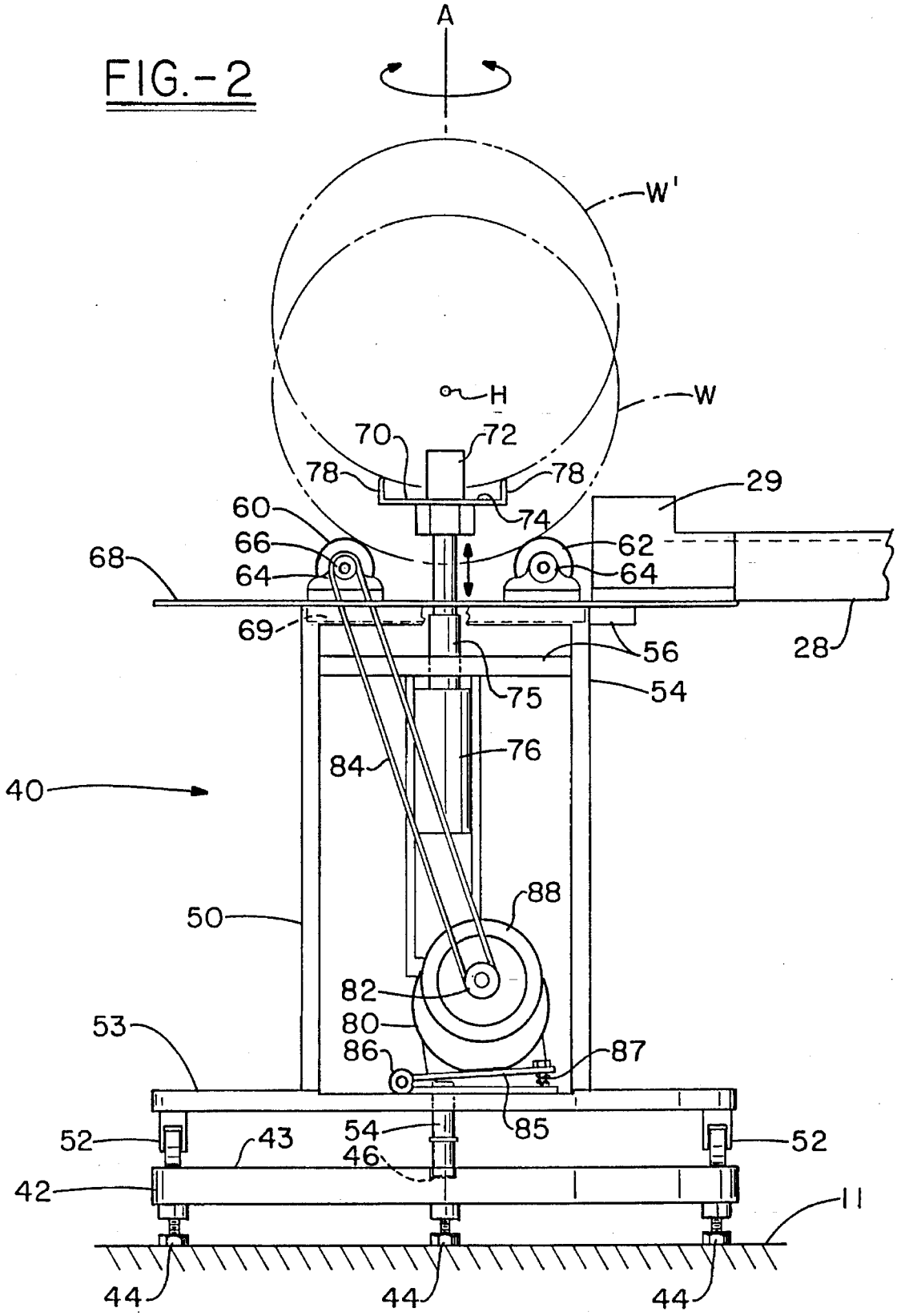
FIG. 2 is a partially broken away side elevational view of the present invention.
Figure 3:
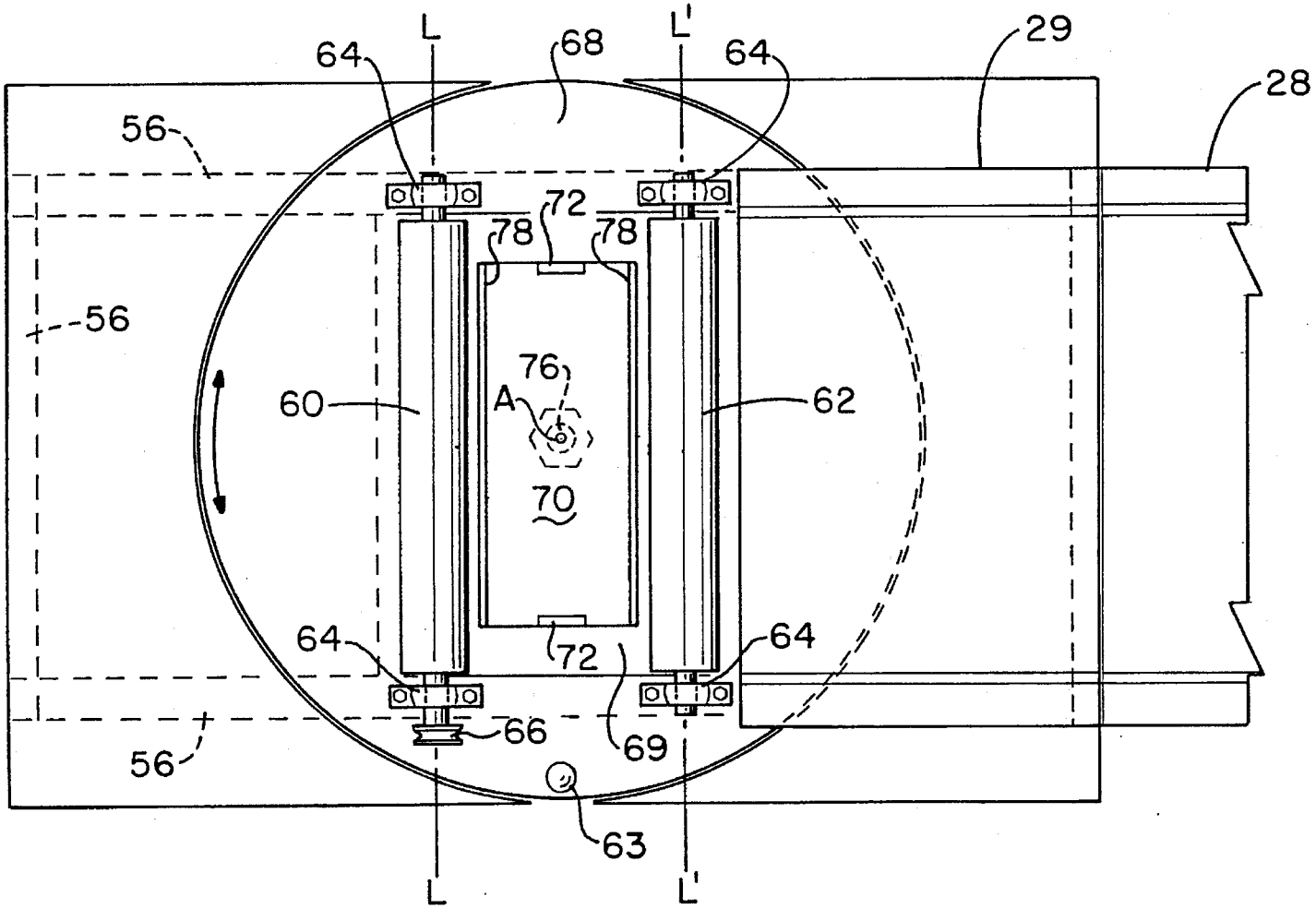
FIG. 3 is a top plan view of the present invention.

Wheel lift rotator 40 is shown in greater detail in FIGS. 2 and 3 and comprises a base 42 designed to rest on a surface such as shop floor 11. Base 42 includes a flat upper surface or track 43 and may include leveling screws 44 to adjust the position of base 42 relative to shop floor 11 and, once positioned as desired, base 42 may be anchored to shop floor 11. Base 42 is designed to support a wheel support frame 50 such that support frame 50 may be rotated about its vertical axis A. Wheel support frame 50 has a lower region 53 including a plurality of casters 52 designed to roll on surface 43 allowing wheel support frame 50 to be rotated relative to base 42. Wheel support frame 50 also preferably includes a pivot pin 54 placed coaxial with the vertical axis A of wheel support frame 50 and designed to be received within a recess 46 formed in base 42 to facilitate the rotation of wheel support frame 50 relative to base 42. As mentioned, base 42 is preferably constructed to provide a circular track or surface 43 upon which casters 52 of wheel support frame 50 may roll when wheel support frame 50 is rotated relative to base 42. Those skilled in the art will recognize the existence of a number of suitable means for rotatably disposing wheel support frame 50 on base 42, and the invention is not meant to be limited to the casters 52 and pivot pin 54 arrangement as is shown. A handle 63 (FIG. 3) is connected to wheel support frame 50 or another suitable location to allow a paint booth operator to rotate wheel support frame 50 upon base 42 as desired.

Upper region 54 of wheel support frame 50 includes one or more horizontal support members 56 upon which at least one roller is provided to cause wheel W to rotate about its horizontal axis H. In the embodiment shown, the at least one roller is provided as a first roller 60 and a second roller 62 mounted in a substantially parallel spaced apart relationship for rotation about their respective longitudinal axes L, L' as seen more clearly in FIG. 3. Rollers 60, 62 are located so as to be able to support a wheel W for rotation about its horizontal axis H so that wheel W rotates at least substantially in its vertical plane. Rollers 60, 62 are preferably made from non-sparking materials such as high density plastic or suitable metals and are supported for rotation by bearing assemblies 64. In the preferred embodiment, either roller 60, roller 62, or both rollers 60, 62 are drivingly coupled to a sheave or pulley 66 to receive torque or rotation from a motor 80 through a belt 84 or other means (described in more detail below) causing roller 60, 62 to which belt 84 is connected to rotate about its longitudinal axis L, L' respectively. In the embodiment shown, roller 60 is drivingly coupled to pulley 66 to receive torque from motor 80 through belt 84 while roller 62 is non-driven and free rolling in response to rotation of the wheel W caused by the driven roller 60.

Rollers 60, 62 are disposed at least partially below the level of tray member 29 to allow a wheel W to be easily rolled from tray member 29 onto rollers 60, 62. A horizontal surface 68 formed of sheet metal or other suitable material is provided to cover substantially all of upper region 54 of wheel support 50 to prevent paint and other debris from falling into areas therebelow, and to minimize vertical air flow within paint booth chamber 22 so that the air flow in the paint booth chamber 22 will be predominantly horizontal from the front access opening 25 to the filter element 30 spanning the rear opening 26 of the paint booth 20. This uniform air flow within paint booth chamber 22 helps to ensure that the minimum air velocity (as may be mandated by various safety agencies) is maintained within paint booth chamber 22. Also, the uniformity of air flow within chamber 22 facilitates the application of a uniform layer of paint or other coating upon wheel W.

A paint trap 69 is formed in the area between rollers 60, 62 to collect and retain excess paint dripping from wheel W or other locations. A wheel lift member such as wheel lift channel 70, including side wheel support members 72 is located in paint trap 69. Wheel lift channel 70 is provided as a means to elevate a coated wheel W to a height where it may be connected to a hook 92 slidably or otherwise movably provided on an overhead monorail 90, allowing the wheel W to be moved out of paint booth chamber 22 on monorail 90. Wheel lift channel 70 is preferably smaller in size relative to paint trap 69 so as to be loosely disposed in paint trap 69. Wheel lift channel 70 includes a floor 74, the underside of which is connected to a rod 75 of a lift mechanism which is shown as a pneumatic fluid cylinder 76. As is shown in FIG. 2, cylinder 76 is mounted below surface 68 and rod 75 of pneumatic cylinder 76 extends from cylinder body 76 up through floor of paint trap 69 and is connected to the underside of floor 74 of wheel lift channel. During painting operations, wheel lift channel 70 is countersunk below surface 68 or otherwise positioned where it will not interfere with rotation of rollers 60, 62, or with rotation of wheel W placed on rollers 60,62. However, when coating of wheel W is substantially complete, pneumatic cylinder 76 is activated to raise wheel lift channel 70 vertically. As wheel lift channel 70 is elevated, sides 78 thereof engage and lift wheel W, as is represented by W' in FIG. 2, to support and lift wheel W vertically above wheel support frame 50, and off of rollers 60, 62. Sides 78 of wheel lift channel 70 are shaped and positioned relative to each other so as to be capable of supporting a wheel W when wheel lift channel 70 is elevated as is described. Side support members 72 are preferably provided to help maintain alignment of wheel W on wheel lift channel 70 when channel 70 is elevated as described. When wheel W is elevated as described, it may be easily connected to hook 92 by the paint booth operator to be removed from the paint booth chamber 22.

A power source such as motor 80 is mounted to lower region 53 of wheel support frame 50 and has a torque output sheave or pulley 82 connected to the output shaft thereof. Belt 84 functions as a means for transferring torque from pulley 82 of motor 80 to driving roller 60 or 62 to which pulley 66 is connected. Motor 80 is mounted to a platform 85 attached to wheel support frame 50 by means of a hinge 86 to provide a means for adjusting the tension of belt 84 using a belt tension adjusting screw 87. Because paint fumes have combustible potential, motor 80 is preferably non-electrically powered and is most preferably a pneumatic motor powered by compressed air delivered to motor 80 through conventional means. The speed of the output shaft of motor 80, and consequently pulley 82 may be regulated by means of a pneumatic flow control valve to regulate the flow of compressed air to motor 80. Motor 80 may be provided with a gear reduction assembly such as a 4:1 gear reducer 88 to allow the speed of pulley 82 and consequently rollers 60, 62 to be more precisely regulated.

In operation, a wheel W is rolled upon conveyor tray 28 to tray member 29 and thereafter onto rollers 60, 62. Motor 80 is activated to drive roller 60 causing wheel W to rotate about its horizontal axis H upon rollers 60, 62. A paint booth operator may direct a flow of spray paint or another similar coating onto wheel W as it is rotating on rollers 60, 62 about its horizontal axis H. Using handle 63, an operator may rotate wheel support frame 50 upon base 42 while wheel W is rotating on rollers 60, 62, allowing the paint booth operator to spray the sides, front, and back of wheel W without requiring difficult and time consuming painting movements by the paint booth operator. The invention as described herein also allows all of the paint to be applied substantially in the same direction as the exhaust flow within the paint booth. This provides for a more uniform finish on the wheel W. For example, it has been found most preferable to coat a wheel W with paint or another similar coating having a thickness in the range of 0.0015" to 0.003" and use of the wheel lift rotator as described herein facilitates applying this preferable thickness of coating. Subsequent to the coating of wheel W, motor 80 is turned off so that wheel W ceases to rotate about its axis H. Pneumatic cylinder 76 is then activated to elevate wheel W so that it may be attached to hook 92 as is described above. After wheel W is attached to hook 92, the paint booth operator may apply any additional paint to wheel W as may be required before wheel W is removed from the paint booth chamber 22.

Although the invention has been described for use in conjunction with a paint booth of a wheel refinishing system, those skilled in the art will recognize that the wheel lift rotator as described herein may be used in conjunction with any paint booth or in conjunction with any other apparatus requiting a workpiece to be simultaneously rotated about both a vertical and a horizontal axis. Further, while the wheel lift rotator 40 is shown in conjunction with a paint booth 20 used in a multi-stage wheel refinishing system 10, it should be understood that the paint booth 20 could exist as a free standing unit in which a wheel W is manually placed onto rollers 60, 62. While the foregoing description has set forth the preferred embodiment of the invention in particular detail, it must be understood that numerous modifications, substitutions, and changes may be undertaken without departing from the true spirit and scope of the present invention as defined by the ensuing claims.

What is claimed:

1. In combination with a coating booth, a wheel lift rotator apparatus to facilitate the coating of a wheel, said apparatus comprising:

a base;

a wheel support frame supported on said base for rotation about a vertical axis relative to said base, said wheel support frame having at least one roller connected thereto for rotatably supporting a wheel within said coating booth, wherein said at least one roller is supported for rotation about a longitudinal axis; and, a power source drivingly connected to said at least one roller for transmitting torque to said at least one roller, whereby a wheel supported on said at least one roller within said coating booth is rotatable about a horizontal axis of said wheel, and is rotatable with said wheel support frame about a vertical axis relative to said base such that substantially all portions of said wheel may be coated with a coating.

2. An apparatus as recited in claim 1, wherein said at least one roller is provided as two rollers positioned in a substantially parallel spaced apart relationship to support a wheel thereon, wherein each of said rollers has a longitudinal axis and each of said rollers is supported for rotation about its longitudinal axis, said power source drivingly connected to at least one of said two rollers.

3. An apparatus as recited in claim 2, wherein said base includes a recess and wherein said wheel support frame includes a pivot pin depending therefrom into said recess to maintain said wheel support frame and said base in a predetermined rotational relationship.

4. An apparatus as recited in claim 2, wherein said wheel support frame further comprises a wheel lift member connected to a lift mechanism such that upon activation of said lift mechanism, said wheel lift member is elevated to engage and elevate said wheel.

5. An apparatus as recited in claim 4, wherein said lift mechanism is a fluid cylinder.

6. An apparatus as recited in claim 5, wherein said wheel lift member is disposed in an area between said two rollers such that upon pressurization of said fluid cylinder, said wheel lift member is elevated to lilt said wheel off of said two rollers.

7. An apparatus as recited in claim 6, wherein said wheel support frame further comprises an upper surface including a paint trap formed therein, and wherein said wheel lift member is located within said paint trap.

8. An apparatus as recited in claim 2, further comprising a handle connected to said wheel support frame to allow an operator to manually rotate said wheel support frame relative to said base.

9. An apparatus as recited in claim 1, wherein said power source is a pneumatic motor.

10. An apparatus as recited in claim 1 wherein said wheel support frame is rotatably supported on said base by at least one caster.

11. An apparatus as recited in claim 1, wherein said base includes a recess and wherein said wheel support frame includes a pivot pin depending therefrom into said recess to maintain said wheel support frame and said base in a predetermined rotational relationship.

12. An apparatus as recited in claim 1, wherein said wheel support frame further comprises a wheel lift member connected to a lift mechanism such that upon activation of said lift mechanism, said wheel lift member is elevated to engage and elevate said wheel.

13. An apparatus as recited in claim 12, wherein said lift mechanism is a fluid cylinder.

14. An apparatus as recited in claim 1, further comprising a handle connected to said wheel support frame to allow an operator to manually rotate said wheel support frame relative to said base.

15. An apparatus as recited in claim 1, further comprising at least one leveling screw attached to said base.

16. An apparatus as recited in claim 1, wherein said wheel support frame further comprises a tray member adjacent to said at least one roller for rolling a wheel onto said at least one roller.

17. A method of coating substantially all portions of a wheel in a coating booth comprising the steps of:

providing a wheel support frame having upper and lower regions wherein said wheel support frame is supported on a base for rotation about a vertical axis relative to said base, said upper region of said wheel support frame having at least one roller connected thereto, wherein said at least one roller has a longitudinal axis and is supported for rotation about said longitudinal axis;

placing a wheel upon said at least one roller such that said wheel is rotatably supported within said coating booth;

rotating said wheel about a horizontal axis upon said at least one roller while directing a spray coating onto said rotating wheel:

and rotating said wheel support frame about said vertical axis relative to said base, such that said wheel is substantially coated by said spray coating.

* * * * *